US007318711B2

(12) United States Patent
Shin et al.

(10) Patent No.: US 7,318,711 B2
(45) Date of Patent: Jan. 15, 2008

(54) OIL SUPPLY STRUCTURE OF SCROLL COMPRESSOR

(75) Inventors: Dong-koo Shin, Kyunggi-Do (KR); Yang-hee Cho, Seoul (KR); Cheol-hwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/212,988

(22) Filed: Aug. 26, 2005

(65) Prior Publication Data

US 2006/0222550 A1 Oct. 5, 2006

(30) Foreign Application Priority Data

Mar. 30, 2005 (KR) ..... 10-2005-0026608

(51) Int. Cl.
*F04C 18/02* (2006.01)

(52) U.S. Cl. ..... 418/55.6; 418/55.6; 418/55.1

(58) Field of Classification Search ..... 418/55.6, 418/55.1

See application file for complete search history.

(56) References Cited

U.S. PATENT DOCUMENTS

| | | | | | |
|---|---|---|---|---|---|
| 4,621,993 | A * | 11/1986 | Nakamura et al. | ..... | 418/55.6 |
| 4,637,786 | A * | 1/1987 | Matoba et al. | ..... | 418/55.3 |
| 4,702,681 | A * | 10/1987 | Inaba et al. | ..... | 418/55.6 |
| 5,217,359 | A * | 6/1993 | Kawahara et al. | ..... | 418/55.4 |
| 5,645,408 | A * | 7/1997 | Fujio et al. | ..... | 418/55.4 |
| 5,716,202 | A * | 2/1998 | Koyama et al. | ..... | 418/55.6 |
| 5,931,650 | A * | 8/1999 | Yasu et al. | ..... | 418/55.3 |
| 6,017,205 | A * | 1/2000 | Weatherston et al. | ..... | 418/55.6 |
| 6,290,479 | B1 * | 9/2001 | Friedley et al. | ..... | 418/55.6 |
| 6,386,840 | B1 * | 5/2002 | Williams et al. | ..... | 417/371 |
| 7,044,723 | B2 * | 5/2006 | Morozumi et al. | ..... | 418/55.6 |
| 2002/0051719 | A1 * | 5/2002 | Shiibayashi et al. | ..... | 418/55.2 |

FOREIGN PATENT DOCUMENTS

| | | | |
|---|---|---|---|
| JP | 2002-168183 | | 6/2002 |
| KR | 10-2005-0026625 | * | 8/2006 |
| KR | 10-2005-0026617 | * | 9/2006 |
| KR | 10-2005-0027166 | * | 10/2006 |

* cited by examiner

*Primary Examiner*—Thomas Denion
*Assistant Examiner*—Mary A. Davis
(74) *Attorney, Agent, or Firm*—Lee, Hong, Degerman, Kang & Schmadeka

(57) ABSTRACT

Disclosed herein is an oil supply structure of a scroll compressor capable of preventing a sludge clog phenomenon in a fine hole of an oil supply screw. The oil supply structure comprises a backpressure space defined between an orbiting scroll and a main frame of the compressor, a screw bore perforated through the main frame between the backpressure space and a space defined between a fixed scroll and the main frame, and the oil supply screw fastened in the screw bore and having a stepped screw body including upper and lower portions of different diameters. The upper and lower portions of the screw body are vertically perforated, through the center thereof, with a center hole and a fine hole, respectively, to form an orifice. An entrance end of the lower portion of the screw body is exposed to the backpressure space, thereby preventing the fine hole of the oil supply screw from being clogged with sludge.

16 Claims, 5 Drawing Sheets

OIL SUPPLY STRUCTURE OF SCROLL COMPRESSOR

CROSS REFERENCE TO RELATED APPLICATIONS

Pursuant to 35 U.S.C. § 119(a), this application claims the benefit of earlier filing date and right of priority to Korean Patent Application No. 10-2005-0026608, filed on Mar. 30, 2005, the content of which is hereby incorporated by reference herein in its entirety.

BACKGROUND OF THE INVENTION

1. Field of the Invention

The present invention relates to an oil supply structure of a scroll compressor, and more particularly, to an oil supply structure of a scroll compressor that is capable of preventing a fine hole of an oil supply screw from being clogged with sludge.

2. Description of the Related Art

FIG. 1 is a longitudinal sectional view illustrating the interior configuration of a conventional scroll compressor.

As shown in FIG. 1, the conventional scroll compressor includes a shell 1, and main and sub flames 2 and 3 respectively arranged in the shell 1 at upper and lower portions of the shell 1. A stator 4 is mounted in the shell 1 between the main and sub frames 2 and 3. A rotor 5 is arranged inside the stator 4 such that it rotates when current flows through the stator 4.

A vertical crankshaft 6 is inserted and fixed through a central portion of the rotor 5 to rotate along with the rotor 5. The crankshaft 6 is rotatably supported at upper and lower ends thereof by the main and sub frames 2 and 3.

An orbiting scroll 7 is mounted to an upper surface of the main frame 2 in the shell 1. The orbiting scroll 7 is coupled at a lower portion thereof with the crankshaft 6, and is provided at an upper portion thereof with an orbiting wrap 7*a* having an involuted shape. A fixed scroll 8 is arranged on the orbiting scroll 7 in the shell 1 while being fixed to the shell 1. The fixed scroll 8 is provided with a fixed wrap 8*a* adapted to be engaged with the orbiting wrap 7*a* of the orbiting scroll 7 such that compression chambers 21 are defined between the wraps 7*a* and 8*a*. With this configuration, when the orbiting scroll 7 performs an orbiting motion in accordance with rotation of the crankshaft 6, gaseous refrigerant is introduced into the compression chambers 21 to be compressed.

To couple the orbiting scroll 7 to the crankshaft 6, the crankshaft 6 is provided with a crank pin 10 upwardly protruded from the upper end of the crankshaft 6 at a position radially spaced apart from the center of the upper end of the crankshaft 6 by a certain distance. Also, the orbiting scroll 7 is provided, at the lower portion thereof, with a boss 7*b* centrally protruded from a lower surface of the orbiting scroll 7. A bearing 11 is forcibly fitted into the boss 7*b*. Also, an eccentric bush 12 is rotatably fitted around the crank pin 10. The crank pin 10 of the crankshaft 6 is inserted into the boss 7*b* of the orbiting scroll 7 via the bearing 11 and eccentric bush 12, so that the orbiting scroll 7 is coupled to the crankshaft 6.

As a rotation preventing mechanism for the orbiting scroll 7, an Oldham ring 9 is arranged between the main frame 2 and the orbiting scroll 7. An oil passage 6*a* is vertically perforated through the crankshaft 6. Upper and lower balance weight members 13 and 14 are provided at upper and lower surfaces of the rotor 5, respectively, in order to prevent rotational unbalance of the crankshaft 6 caused by the crank pin 10.

As the high-pressure gaseous refrigerant, which is compressed in the compression chambers, is discharged through a discharge port 17 of the fixed scroll 8, it applies shock to a top cap 1 a of the shell 1 to thereby generate noise. For this reason, a muffler 22, having a cap shape, is arranged on the fixed scroll 8 to attenuate the noise.

In addition to the noise attenuation function as stated above, when the muffler 22 is employed in a high-pressure scroll compressor in which the high-pressure gaseous refrigerant is discharged to a lower portion of the compressor, the muffler 22 also serves to separate a low-pressure region, that is affected by a suction pressure, from a high-pressure region that is affected by a discharge pressure. The fixed scroll 8 is provided with a passage guide 23 in order to guide the compressed gaseous refrigerant inside the muffler 22 to the lower portion of the compressor.

In FIG. 1, reference numerals 15 and 16 designate suction and discharge pipes, respectively, reference numeral 18 designates a discharge chamber, reference numeral 19 designates oil, and reference numeral 20 designates an oil propeller.

When current flows through the stator 4, the rotor 5 is rotated inside the stator 4, thereby causing the crankshaft 6 to rotate. In accordance with the rotation of the crankshaft 6, the orbiting scroll 7 coupled to the crank pin 10 of the crankshaft 6 performs an orbiting motion with an orbiting radius defined between the center of the crankshaft 6 and the center of the orbiting scroll 7.

In accordance with a continued orbiting motion of the orbiting scroll 7, the compression chambers 21, which are defined between the orbiting wrap 7*a* and the fixed wrap 8*a*, are gradually reduced in volume, so that gaseous refrigerant sucked into each compression chamber 21 is compressed to high pressure. The compressed high-pressure gaseous refrigerant is subsequently discharged into the discharge chamber 18 via the discharge port 17. The compressed high-pressure gaseous refrigerant is then directed to the lower portion of the compressor via the passage guide 23 of the fixed scroll 8 to thereby be discharged to the outside via the discharge pipe 16.

FIG. 2 is a partially enlarged sectional view of FIG. 1.

As shown in FIG. 2, the main frame 2 is provided with an oil supply screw 24. If oil is fed into a backpressure space C1, that is defined between the orbiting scroll 7 and the main frame 2, via the crankshaft 6 in accordance with operation of the compressor, the oil supply screw 24 supplies the oil from the backpressure space C1 into a space C2 that is defined between the fixed scroll 8 and the main frame 2. Here, the backpressure space C1 forms a high-pressure chamber, and the space C2 forms a low-pressure chamber.

FIG. 3 is a perspective view illustrating a cut-away half section of the oil supply screw of FIG. 2.

As shown in FIG. 3, the oil supply screw 24 has a stepped screw body 25 having upper and lower portions of different diameters. The screw body 25 is externally formed with threads 26 to be screwed into a screw bore 2*a* of the main frame 2.

An orifice 27 is perforated through a central portion of the screw body 25. The orifice 27 includes a center hole 28 formed at the upper portion of the screw body 25, and a fine hole 29 formed at the lower portion of the screw body 25 to communicate with the center hole 28. The fine hole 29 has a smaller diameter than the center hole 28 and is centered about the center hole 28. With such a configuration, the orifice 27 is able to achieve the appropriate supply of oil while eliminating the interference of the discharge pressure.

However, the oil supply screw of the conventional scroll compressor has a problem in that the diameter of the fine hole of the orifice is extremely small and an entrance end of the oil supply screw has an even structure. This causes various foreign matter and sludge contained in the oil to be accumulated at the entrance end of the oil supply screw to thereby be introduced into the fine hole.

As a result, the fine hole of the oil supply screw is clogged with the various foreign matter and sludge contained in the oil, making it impossible to supply an appropriate amount of oil to a compression unit, and consequently degrading performance and reliability of the scroll compressor.

SUMMARY OF THE INVENTION

Therefore, the present invention has been made in view of the above problems, and it is an object of the present invention to provide an oil supply structure of a scroll compressor which can prevent a fine hole of an oil supply screw, that is arranged between a backpressure space, defined between an orbiting scroll and a main frame, and a space, defined between a fixed scroll and the main frame, from being clogged with sludge.

In accordance with the present invention, the above, and other objects can be accomplished by the provision of an oil supply structure of a scroll compressor comprising: a backpressure space defined between an orbiting scroll and a main frame; a screw bore perforated through the main frame between the backpressure space and a space defined between a fixed scroll and the main frame; and an oil supply screw fastened in the screw bore and having a stepped screw body including upper and lower portions of different diameters, the upper and lower portions of the screw body being vertically perforated, through the center thereof, with a center hole and a fine hole, respectively, to form an orifice, an entrance end of the lower portion of the oil supply screw being exposed to the backpressure space.

Preferably, an oil recess may be formed in the main frame underneath the entrance end of the oil supply screw.

Preferably, the oil recess may define a concave arched surface portion.

Preferably, the screw bore of the main frame may have a fixing protrusion formed inside an entrance thereof.

Preferably, the oil recess may be successively formed with the fixing protrusion.

Preferably, the screw bore of the main frame may further have an oil path formed at an upper end thereof, the oil path having a diameter larger than that of the screw bore.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
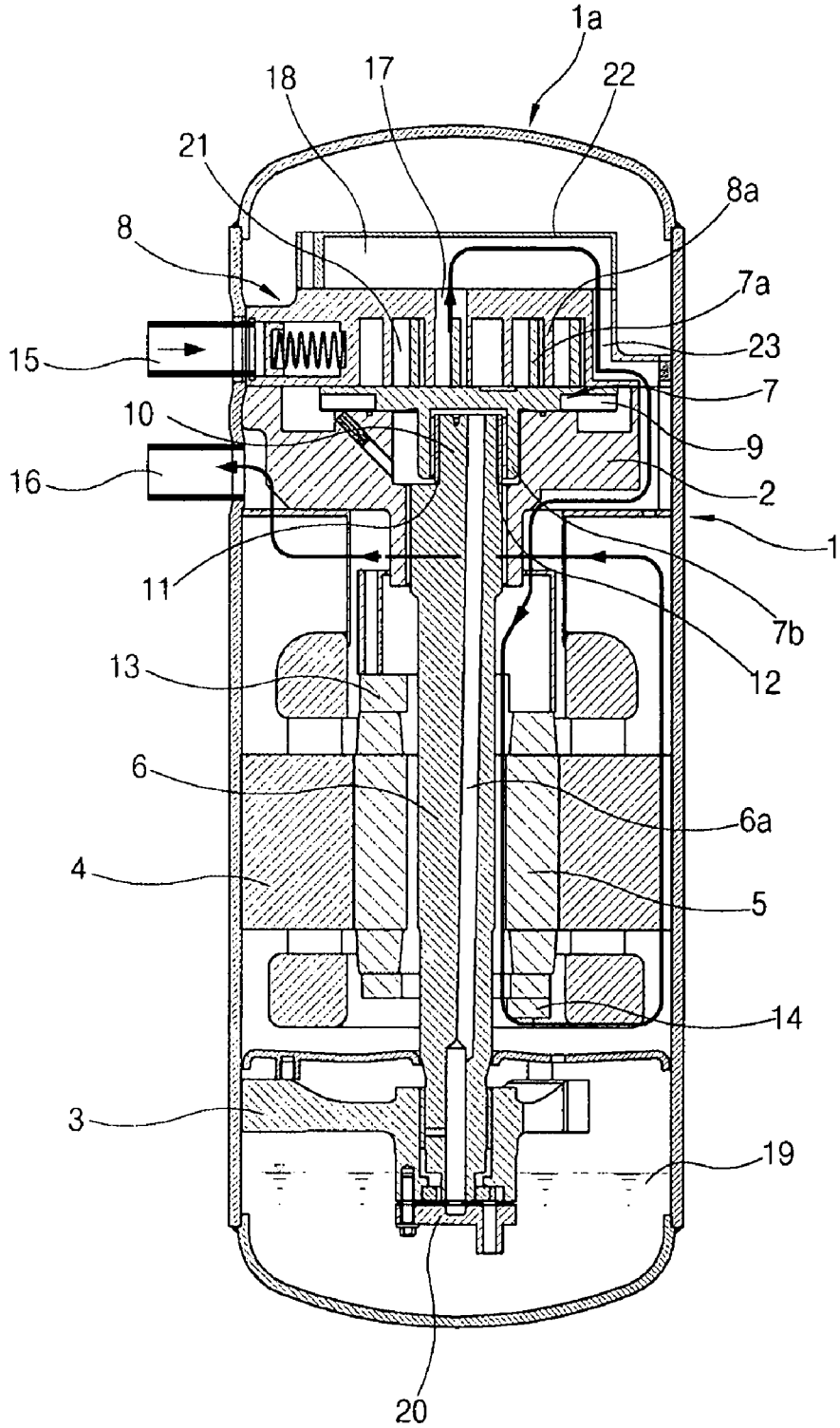
Fig.1 Related Art
FIG. 1 is a longitudinal sectional view illustrating the interior configuration of a conventional scroll compressor.

Now, a preferred embodiment of the present invention will be explained with reference to the accompanying drawings. Where possible, the same reference numerals will be used throughout the drawings to refer to the same or like parts.

Figure 2:
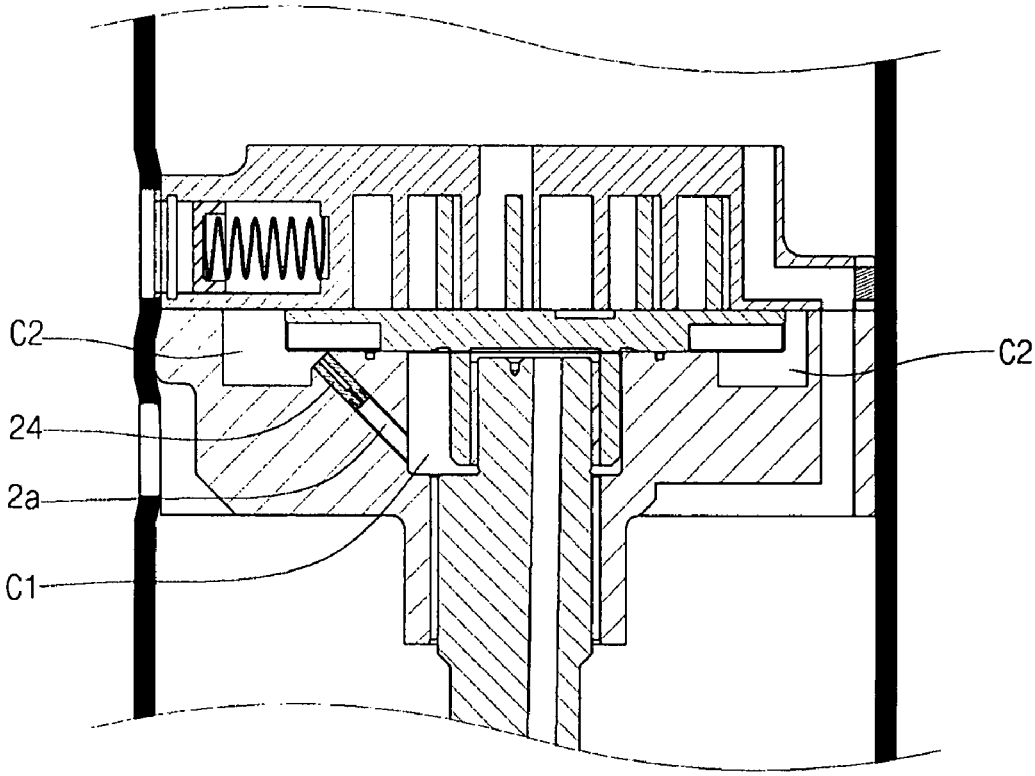
Fig.2 Related Art
FIG. 2 is a partially enlarged sectional view of FIG. 1.

As described above in relation with FIG. 2, similar to the prior art, an oil supply screw of a scroll compressor according to the present invention is screwed into the screw bore 2*a* of the main frame 2 perforated between the backpressure space C1 and the space C2. The backpressure space C1 is defined between the orbiting scroll 7 and the main frame 2 and forms a high-pressure chamber, and the space C2 is defined between the fixed scroll 8 and the main frame 2 and forms a low-pressure chamber.

Figure 3:
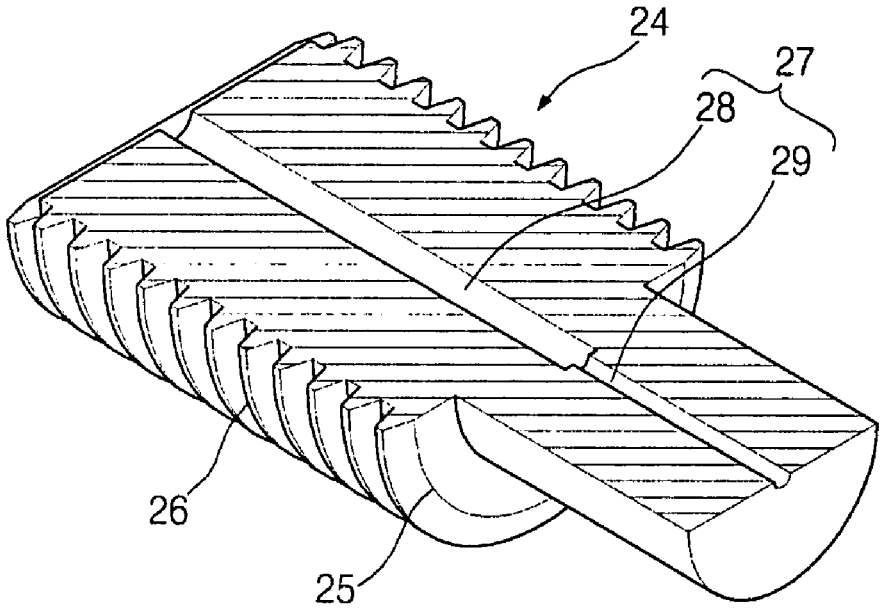
Fig.3 Related Art
FIG. 3 is a perspective view illustrating a cut-away half section of an oil supply screw of FIG. 2.

As shown in FIG. 3, the screw body 25 of the oil supply screw is externally formed with the threads 26 to be screwed into the screw bore 2*a* of the main frame 2. The orifice 27 is perforated through the central portion of the screw body 25 to supply oil inside the backpressure space C1 to the space C2 defined between the fixed scroll 8 and the main frame 2.

The orifice 27 includes the center hole 28 that is vertically perforated through the center of the upper portion of the screw body 25, and the fine hole 29 that is perforated through the lower portion of the screw body 25 to be coaxially extended from a lower end of the center hole 28.

Figure 4:
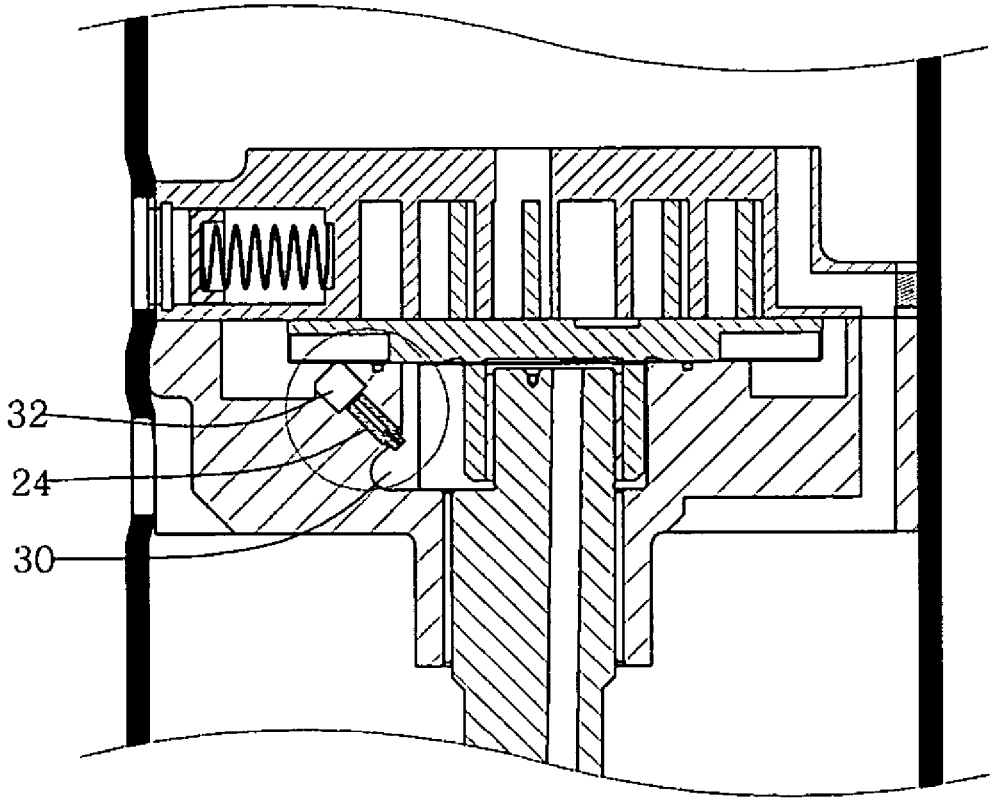
FIG. 4 is a partially enlarged sectional view illustrating a compression unit of a scroll compressor according to the present invention.
Figure 5:
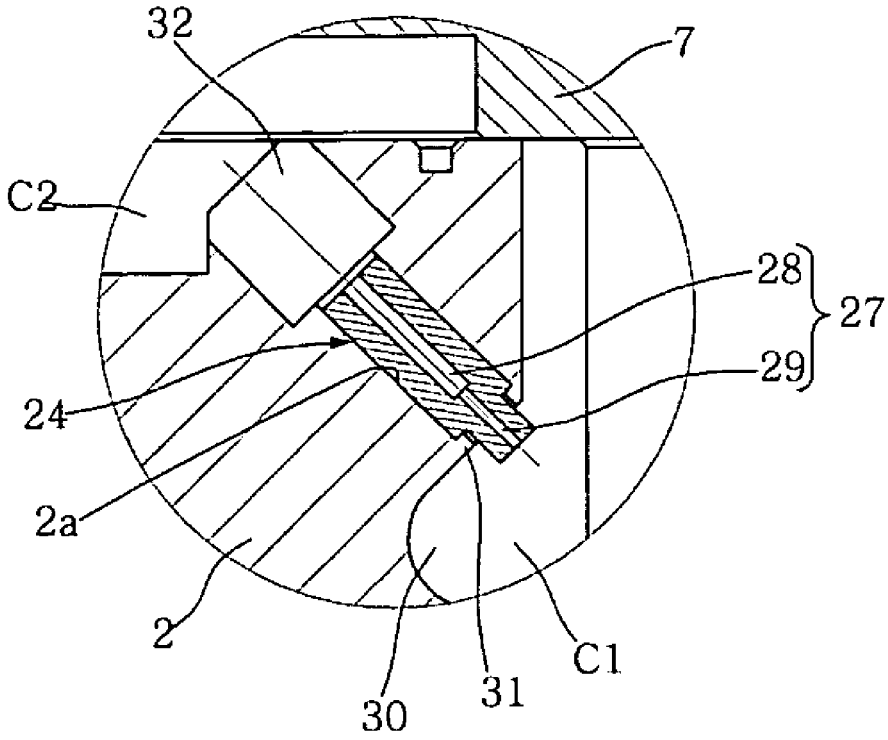
FIG. 5 is an enlarged sectional view illustrating the circle "A" of FIG. 4.

FIG. 4 is a partially enlarged sectional view illustrating a compression unit of a scroll compressor according to the present invention. FIG. 5 is an enlarged sectional view illustrating the circle "A" of FIG. 4.

As shown in FIGS. 4 and 5, in the scroll compressor of the present invention, the oil supply screw is screwed into the screw bore 2*a* of the main frame 2 such that a lower entrance end of the screw body 25 is exposed to the backpressure space C1. In this case, it is preferable that the entrance end of the screw body 25 be located at a predetermined height of the backpressure space C1. In the exemplary embodiment shown in FIG. 4, the entrance end of the screw body 25 is located at an approximately middle height of the backpressure space C1

If the entrance end of the screw body 25 is located at an extremely low position, there exists the risk of causing various foreign matter or sludge contained in oil to be introduced directly into the entrance end of the screw body 25 exposed to the backpressure space C1. To more effectively prevent invasion of foreign matter or sludge, in the embodiment of the present invention, an oil recess 30 is formed in the main frame 2 underneath the entrance end of the screw body 25, which is located at the approximately middle height of the backpressure space C1.

Inside an entrance of the screw bore 2*a* of the main frame 2 is formed a fixing protrusion 31. The fixing protrusion 31 is configured to catch a stepped portion of the screw body 25 having the upper and lower portions of different diameters to thereby immobilize the screw body 25. The oil recess 30 is successively extended downward from the fixing protrusion 31 and forms a concave arched surface portion inside the main frame 2.

In addition to the fixing protrusion 31, an oil path 32, with a diameter larger than that of the screw bore 2*a*, is formed at an upper end of the screw bore 2*a* of the main frame 2. The oil path 32 communicates with the space C2, which is defined between the fixed scroll 8 and the main frame 2 and forms a low-pressure chamber.

With this configuration, since the entrance end of the screw body 25 is exposed to the backpressure space C1 between the orbiting scroll 7 and the main frame 2, various foreign matter or sludge contained in oil can be dispersed rather than accumulated at the entrance end of the screw body 25. Thus, the possibility that the fine hole 29 of the screw body 25 is clogged with sludge is greatly reduced.

Also, since the oil recess 30, forming a concave arched surface portion inside the main body 2, is provided underneath the entrance end of the screw body 25, it is possible to achieve an oil spread space around the entrance end of the screw body 25.

The oil recess 30 is successively extended from the fixing protrusion 31 formed inside the entrance of the screw bore 2*a* Such a configuration is effective to prevent sludge from being accumulated in the vicinity of the entrance end of the screw body 25, thereby preventing invasion of sludge into the fine hole 29. The fixing protrusion 31 also serves to prevent the screw body 25 from falling from the screw bore 2*a* into the backpressure space C1.

In addition to the fixing protrusion 31, as stated above, the screw bore 2*a* of the main frame 2 is formed at the upper end thereof with the oil path 32 with a diameter larger than that of the screw bore 2*a*. The oil path 32 enables effective spread and dispersion of oil that is discharged through the orifice 27 of the screw body 25, thereby achieving smooth oil supply to reciprocating surfaces of a compression unit.

As apparent from the above description, the present invention provides an oil supply structure of a scroll compressor, which is capable of preventing a fine hole of an oil supply screw, that is arranged between a backpressure space, defined between an orbiting scroll and a main frame, and a space, defined between a fixed scroll and the main frame, from being clogged with sludge. This is achieved by providing sludge discharge means, having an uneven structure, at an entrance end of the oil supply screw. Preventing clogging of the oil supply screw consequently enables the appropriate supply of oil to a compression unit, resulting in an improvement in the performance and reliability of the scroll compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An oil supply structure of a scroll compressor comprising:

a backpressure space defined between an orbiting scroll and a main frame;

a screw bore perforated through the main frame between the backpressure space and a space defined between a fixed scroll and the main frame; and an oil supply screw fastened in the screw bore and having upper and lower portions of different diameters to thereby form a stepped shape, wherein an entrance end of the lower portion of the oil supply screw is fixed to a fixing protrusion formed inside and entrance of the screw bore and is protruded to be exposed to the backpressure space outside the fixing protrusion.

2. The structure as set forth in claim 1, wherein:

the upper portion of the oil supply screw has a diameter larger than that of the lower portion of the screw; and the oil supply screw is externally threaded.

3. The structure as set forth in claim 2, wherein the oil supply screw has an orifice formed in a central portion thereof.

4. The structure as set forth in claim 3, wherein the orifice includes:

a center hole vertically formed in the center of the upper portion of the oil supply screw; and a fine hole formed in the lower portion of the oil supply screw to be coaxially extended from a lower end of the center hole.

5. The structure as set forth in claim 4, wherein an oil recess is formed in the main frame underneath the entrance end of the oil supply screw.

6. The structure as set forth in claim 5, wherein the oil recess defines a concave arched surface portion.

7. The structure as set forth in claim 1, wherein the fixing protrusion is successively formed with the oil recess.

8. The structure as set forth in claim 1, wherein the screw bore of the main frame has an oil path formed at an upper end thereof, the oil path having a diameter larger than that of the screw bore.

9. The structure as set forth in claim 8, wherein the oil path communicates with the space that is defined between the fixed scroll and the main frame and forms a low-pressure chamber.

10. A scroll compressor comprising:

main and sub frames respectively arranged in a shell at upper and lower portions of the shell;

a crankshaft rotatably supported at upper and lower ends thereof by the main and sub frames;

an orbiting scroll coupled to the upper end of the crankshaft and internally provided with an orbiting wrap having an involuted shape;

a fixed scroll having a fixed wrap to be engaged with the orbiting wrap;

a screw bore perforated between a space, that is defined between the fixed scroll and the main frame, and a backpressure space that is defined between the orbiting scroll and the main frame;

an oil supply screw fastened in the screw bore and having upper and lower portions of different diameters to thereby form a stepped shape; and an oil recess formed in the main frame underneath an entrance end of the oil supply screw, wherein an entrance end of the lower portion of the oil supply screw is fixed to a fixing protrusion formed inside an entrance of the screw bore and is protruded to be exposed to the backpressure space outside the fixing protrusion.

11. The compressor as set forth in claim 10, wherein the oil recess defines a concave arched surface portion.

12. The compressor as set forth in claim 10, wherein:

the upper portion of the oil supply screw has a diameter larger than that of the lower portion of the screw; and the oil supply screw is externally threaded.

13. The compressor as set forth in claim 12, wherein the oil supply screw has an orifice formed in a central portion thereof.

14. The compressor as set forth in claim 13, wherein the orifice includes:

a center hole vertically formed in the center of the upper portion of the oil supply screw; and a fine hole formed in the lower portion of the oil supply screw to be coaxially extended from a lower end of the center hole.

15. The compressor as set forth in claim 10 further comprising an oil path formed at an upper end of the screw bore, the oil path having a diameter larger than that of the screw bore.

16. The compressor as set forth in claim 15, wherein the oil path communicates with the space that is defined between the fixed scroll and the main frame and forms a low-pressure chamber.

* * * * *